US006474830B1

(12) United States Patent
Hansen

(10) Patent No.: US 6,474,830 B1
(45) Date of Patent: Nov. 5, 2002

(54) MULTI-PURPOSE ILLUMINATION DEVICE ADAPTABLE FOR USE AS A BUTTON FASTENER

(75) Inventor: Janet Cooke Hansen, Encinitas, CA (US)

(73) Assignee: Enlighted Designs, Inc., Encinitas, CA (US)

( * ) Notice: Subject to any disclaimer, the term of this patent is extended or adjusted under 35 U.S.C. 154(b) by 0 days.

(21) Appl. No.: 09/849,650

(22) Filed: May 4, 2001

(51) Int. Cl.[7] ..... F21V 21/08
(52) U.S. Cl. ..... 362/103; 362/108
(58) Field of Search ..... 362/103, 105, 362/106, 108, 249, 238, 253, 800; 24/114.9

(56) References Cited

U.S. PATENT DOCUMENTS 3,737,647 A * 6/1973 Gomi ..... 362/800
4,308,572 A 12/1981 Davidson et al.
4,570,206 A * 2/1986 Deutsch ..... 362/103
4,924,362 A 5/1990 Janko et al.
5,113,325 A * 5/1992 Eisenbraun ..... 362/103
5,278,734 A 1/1994 Ferber
5,440,461 A 8/1995 Nadel et al.
5,575,554 A 11/1996 Guritz

* cited by examiner

*Primary Examiner*—Sandra O'Shea
*Assistant Examiner*—Bao Truong
(74) *Attorney, Agent, or Firm*—Higgs Fletcher & Mack LLP; Charles F. Reidelbach, Jr.

(57) ABSTRACT

This self-contained multipurpose illumination device offers an individual a unique device that cannot only be used to adorn dress apparel, but may be easily removed and adapted for use in other applications, such as a safety device in adverse environments. The apparatus contains a series of illumination elements shaped similar to a shirt button stud which may be inserted through any common buttonhole or similar orifice in a garment. The illumination elements are connected to a control circuit and power source by way of a wiring harness.

11 Claims, 2 Drawing Sheets

MULTI-PURPOSE ILLUMINATION DEVICE ADAPTABLE FOR USE AS A BUTTON FASTENER

FIELD OF THE INVENTION

This invention relates to a self-contained illumination apparatus for use on an article of apparel having one or more existing buttonholes or similar orifices, or on any article capable of incorporating one or more orifices. The apparatus contains a series of illumination elements which are inserted through the buttonhole or orifice in a similar manner as a typical button fastener. The illumination functions are controlled by a circuit board and on and off switch, attached to a power source and connected to the illumination elements by the means of a conductive pathway.

BACKGROUND OF THE INVENTION

This invention describes a new and unique apparatus to enhance wearing apparel drawing attention to the person wearing the article, or drawing attention to the article itself. It has been common for many years to adorn formal attire with jewelry, as in men's dress shirts that come with matching buttonholes instead of the button and buttonhole combination where jeweled studs replace the buttons. Rhinestones, pearls and other jewelry used on evening gowns make them sparkle and more noticeable. Adorning professional and amateur entertainers' wearing apparel, as well as children's costumes is common practice.

Drawing attention to oneself in adverse environments also serves to promote safety, as in highway workers working at night, or bicyclist and walkers on roadsides. Wearing bright colors has helped in most circumstances, but at night colors alone are often inadequate. There are many situations where an additional form of eye-catching adornment would help to draw attention to those in adverse environments. One such example is a lost child in a crowd at night.

A variety of devices have been developed for illuminating articles of apparel, such as shirts, sweaters and the like. The following patents present a representation of such state-of-the-art devices.

U.S. Pat. No. 4,308,572 of Sidney Davidson, et al. relates to an article, preferably in the form of an article of clothing having a plurality of holes arranged in a predetermined pattern with light emitting elements associated therewith, which are energized in sequence to provide desired visual displays. The light emitting elements, such as diodes, are mounted on a substrate, preferably a flexible and foldable type of printed circuit board and which diodes are sized to project through the holes so as to render an appearance that they are mounted on the surface of the fabric. This invention is limited in that the placement of the light emitting elements are permanently fixed on the article, and therefore is not adaptable for use on other articles or for different applications.

U.S. Pat. No. 4,570,206 of Claude Deutsch describes an electrically controlled optical display apparatus for embellishing or decorating a design on a garment. A removable display apparatus that has lamps and electrical connectors is disposed in a composite removable patch on the inside of the garment. The lamps project outside the garment and are held by elastic clamping members surrounding the luminous heads of the lamps. Again, this patent describes an article of clothing with a fixed illuminating display, not to be easily removed or used for other purposes.

U.S. Pat. No. 4,924,362 of Michael Janko et al. discloses an illuminated article, preferably an illuminated garment or article of wearing apparel. An electrically conductive harness is mounted on the article or garment at any desired location. The harness includes a pair of electrical conductors connected to an electrical power source carried by the article. An illumination means, such as light emitting diodes are connected at spaced locations to the electrical conductors. This invention teaches an illuminated garment, not an article for illuminating a garment, with many other practical uses.

U.S. Pat. No. 5,278,734 of Andrew R. Ferber teaches a light illuminating assembly having at least one light emitting element that is operatively associated with the decoration on the exterior of the wearing apparel and has an improved assembly for securing the light emitting element in predetermined openings on the article. Although this patent has singular illumination elements with a holding feature to go through a specific hole in a pattern on a garment, the wiring indicates that all the lights would be on at the same time, and does not permit different illumination patterns and intensities. Additionally, the device requires effort for cleaning the article, is not easily adaptable for other uses, and cannot be used directly on any form of commercially available garment.

U.S. Pat. No. 5,440,461 of Craig P. Nadel describes a light illuminating assembly having at least one light emitting element that is operatively associated with a decoration on the exterior of wearing apparel that includes an assembly for securing the light emitting elements thereto, without the need for predetermined openings in the fabric of the apparel for accommodating the light emitting elements. The securing assembly includes a two-piece enclosure for each light emitting element. The electrodes of the light emitting elements penetrate the fabric and are pressed into engagement with an electrically conductive pattern formed or carried on the interior surface of the interposed section of fabric. Again the garment must be specifically designed for the particular article in which it is used, and cannot be removed for cleaning or adaptable for other purposes.

U.S. Pat. No. 5,575,554 of Steven P. W. Guritz describes a method of manufacturing wearing apparel with optical display capability, comprised of printing an electrically conductive pathway, having a predetermined pattern, directly onto the apparel with electrical coupling means and connected to a control circuitry and having a power source for illumination. This patent is again, an illuminated garment, and not a device which may be used to illuminate any garment, and is not adaptable for other uses.

Thus with the expanding and ever changing field of apparel display and safety devices, there is an ever-present need for new and unique devices to enhance our activities and have the ability to be adaptable for other practical purposes. More particularly, there is a need for a self-contained illumination apparatus that can have one or more illuminated buttons that will fit through standard or existing buttonholes as in commercially available dress shirts or any other similar orifice through fabric, plastics, leather, or other like materials. There is a need for an illumination apparatus that can be used to adorn and enhance formal apparel or costumes, and that can be removed quickly and easily for cleaning. There is a need for an apparatus that can be removed from a formal dress garment and adaptable to other articles such as a sporting garment for safe evening activities. Finally, there is a need for an apparatus that is adaptable to both a garment as well as article other than wearing apparel, to draw attention to it.

SUMMARY OF THE INVENTION

An object of this invention is to create a self-contained illumination apparatus that can have one or more illuminated buttons that will fit through standard or existing buttonholes as in commercially available dress shirts or any other similar orifice through fabric, plastics, leather, or other like materials.

Another object of this invention is to create a self-contained illumination apparatus that can be used to adorn and enhance evening or formal apparel and costumes, and is quickly and easily removable for cleaning.

Yet another object of this invention is to create an apparatus that may be removed from a dress garment and inserted on a sporting garment for safe evening activities.

Still another object of this invention is to create a self-contained illumination apparatus that can be used additionally for safety when an individual is required to be in an adverse environment after dark.

A further object of this invention is to create an apparatus that is adaptable for use on a garment as well as an article other than wearing apparel, to draw attention to it. A final object of this invention is to create a truly unique and yet simple multipurpose, multifunctional self-contained illumination apparatus.

The present invention accomplishes its desired objectives by creating a simple, yet very effective, apparatus for enhancing wearing apparel while the same apparatus can be removed easily and used for other practical purposes. In the preferred embodiment of the apparatus, there may be one or more illumination elements or optical display devices connected by a conductive pathway as in an elongated strip or wiring harness to a controlling circuit board encapsulated in the snap fastener on a nine volt battery.

There may be several variations in the electronics of the apparatus staying within the scope of the patent. The apparatus is controlled by the user, the surrounding environment, or through a series of optional inputs. There may be an on-off switch for controlling the power supplied to the control circuit. User input switches may provide a means of manipulation for the current pattern, animation speed, brightness, or other parameters that would affect the appearance and operation of the illumination buttons. There may also be a means by which environmental sensors provide input to the control circuit for the purpose of affecting the lights, including sensors for ambient sound, light, temperature, and motion. Any of these input means can be mounted directly on the controlling circuit board or connected to the circuit board or mounted elsewhere as desired. An alternate means of mounting the sensors would be mounting them in a unit similar to the illumination buttons and connected through the wiring harness.

The preferred embodiment of the illumination buttons may consist of a means of encasing a light emitting diode or similar device in a plastic molded housing resembling a shirt button stud. The structure may consist of a flat button-like top section centered on a cylindrical center section, smaller in diameter than the top, forming the shank of the device, with another button-like section forming the bottom, where the connective wiring is encased. Though the button like structures would commonly have a round shape, it is understood that the buttons can be molded in a wide variety of decorative shapes as long as they are sized to removably fasten through a common buttonhole, orifice, or other loose fabric weave in an article. The shank portion of the illumination button will be large enough in diameter to enclose the light emitting diode and/or connective wiring, so that only the spherical end protrudes beyond the top surface, while maintaining a small enough diameter to fit through a common buttonhole. Commercially available light emitting diodes come in a variety of colors while color caps may be used to cover the white lights as desired.

An additional embodiment of the illumination button will have a transparent dome, attached to the top surface with a light emitting element enclosed within. In addition to surface-mount light emitting diodes, other forms of electrical light emitting elements capable of being housed within the illumination button, projecting outwardly for this purpose, presently available or that are developed within the duration of this patent will be considered within the scope of this patent.

Illumination buttons may be attached to the control circuit by means of an elongated flexible conductor, such as insulated wires formed into a grouping or strip called a harness. The length of the wiring harness and the relative positions of the illumination buttons will vary for the different styles that will be available. The flexibility of the wiring harness will allow comfort to the individual wearing the device close to the body in all forms of activities. The wiring harness can be constructed so that each illumination button is activated independently creating a means for animated effects. Though less desirable, the illumination buttons may also be wired in series or parallel, where only two wires are used, and all the lights go on and off at the same time.

A control circuit on the circuit board distributes power to the illumination buttons and may be designed so that all the lights are lit simultaneously and continuously, or individually and selectively. The brightness, duration, and timing of the illumination for each light, is determined by the control circuitry. The resulting animation may be sequential, random, or designed to produce a particular pattern or multiple patterns. The control circuitry may be constructed by a variety of standard methods. These approaches may involve discrete analog parts and integrated circuits, or it may be preferable to use a microprocessor-based circuit. Some of the variety of circuit boards may be sufficiently small enough to be encapsulated within the snap fastener attached to a battery, with the controlling mechanisms on top. A belt clasp may be an additional feature that can be added to the side of the fastener. Alternately, the control circuit may be housed in a box, pouch, or other enclosure that also holds the battery.

The power source used for the apparatus may be, but is not limited to a nine volt battery with the snap connectors being sufficiently small enough to be hidden inconspicuously inside a garment. Optional enclosures and soft flexible pouches may be used for housing the circuitry and battery of this unique apparatus.

These, together with other objects and advantages that will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

DETAILED DESCRIPTION OF PREFERRED EMBODIMENTS

In the following detailed description, certain specific terminology will be employed for the sake of clarity and a particular embodiment described in accordance with the requirement of 35 U.S.C. 112, but it is to be understood that the same is not intended to be limiting and should not be construed in as much as the invention is capable of taking many forms and variations in the scope of the appended claims.

Figure 1:
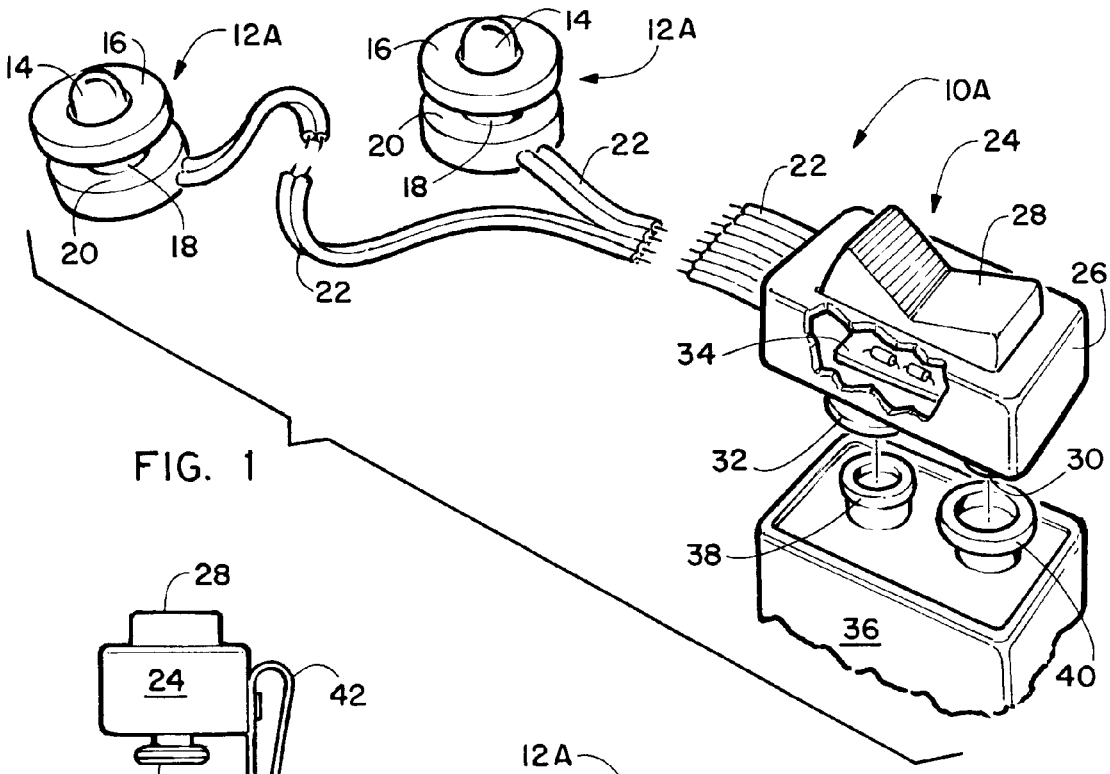
FIG. 1 depicts the preferred embodiment of the illumination device with two, typical illumination buttons attached by means of a flexible wiring harness to the snap fastener, encasing the circuitry and the on-off switch, showing a 9 volt battery removed from the device.

Referring to the drawings in more detail, FIG. 1 illustrates the preferred embodiment of the multipurpose illumination device 10A, and shows two illumination buttons 12A having conventional light emitting diodes 14 for directing light away from the article of apparel. As is shown, the light emitting buttons are shaped similar to a common shirt stud and may also function in a similar manner by fastening one or more parts of an article of apparel. It is to be understood that a variety of illuminating elements may be used in place of a light emitting diode, and the number of illumination buttons may vary depend upon the particular or desired use. Typically, five illumination buttons will be used to correspond to the common number of buttons on a shirt.

Figure 2:
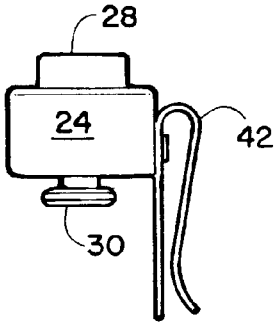
FIG. 2 depicts the end view of the snap fastener with an optional belt hook.

The preferred structure of the illumination button 12A is comprised of a relatively flat-button like top section 16, shown in a cylindrical shape, though it may also be configured in any decorative or geometric shape, while still retaining the magnifying end of the light element protruding through. The size of the top section 16 will be small enough to fit through a common buttonhole or orifice while the center of the illumination elements consist of a cylindrical or other shaped section or shank 18. The shank section 18 is smaller in diameter than the top section 16, but large enough in diameter to retain the light emitting diode 14 with its connective wiring, and still be reasonably engaged by a common buttonhole or similar orifice. The bottom section 20 of the illumination button 12A, may be similar in shape to the top section 16 while being thick enough to house the encapsulated wiring for the light emitting diode 14. The flexible communicative wiring 22, is shown as, but not limited to, a wiring harness connecting one or more illumination buttons 12A to the snap fastener 24. Typically, the illumination buttons 12A will be spaced apart from one another on the wiring harness 22 such that each illumination button 12A will reasonably fit in the buttonholes of a dress shirt. Snap fastener 24 is comprised of a body enclosure 26, an on-off switch 28, a male snap 30, and a female snap 32. Additional controlling switches and knobs can be incorporated on the enclosure 26, to make changes to the optional capabilities of the circuitry. Encapsulated within the body enclosure will be the different available combinations of miniaturized controlling circuitry, mounted on circuit board 34. A common nine volt battery 36, with male snap 38 and female snap 40, may be reasonably engaged with snap fastener 24. This is not to say that other types of batteries and connecting fasteners cannot be used within the realm of this patent. FIG. 2 is an end view of the snap fastener 24 with an optional belt hook 42, though other common means of hooking or clasping, as in an alligator style clamp, may be used to retain the device on the garment.

Figure 3:
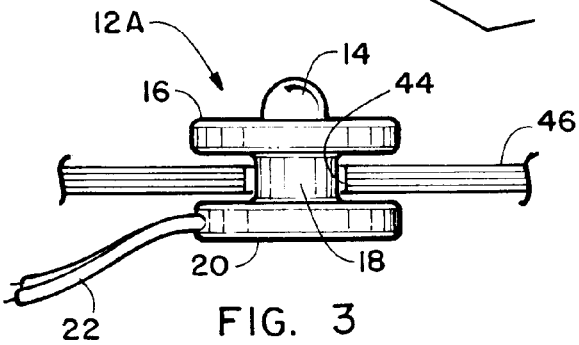
FIG. 3 depicts a typical illumination button inserted through an orifice in a fabric or fabric like material.
Figure 4:
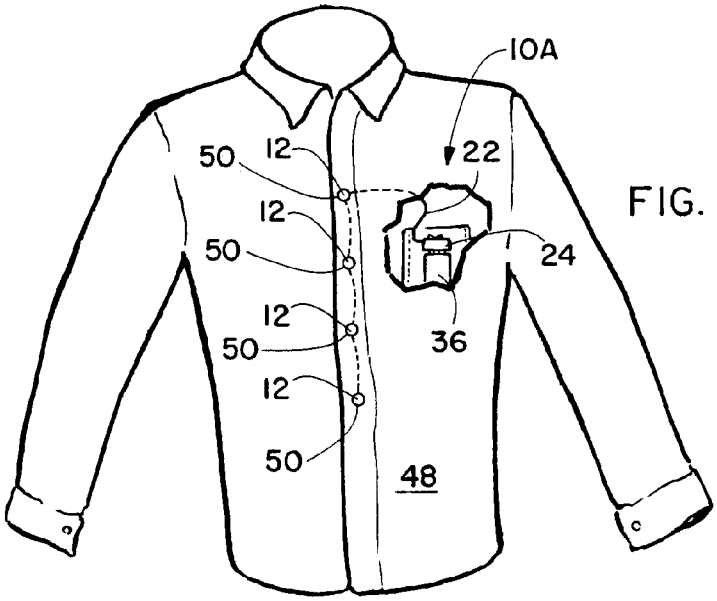
FIG. 4 depicts the illumination device with four illumination buttons inserted through the button holes in a dress shirt, with the front of the shirt cut away to display the snap fastener and battery housed in an inside pocket.

FIG. 3 illustrates the illuminating button 12A engaged in an orifice 44 of a flexible fabric, plastic, leather or other like material 46. FIG. 4 displays the illumination assembly 10A in use on a dress shirt 48, with the illumination buttons 12A protruding through buttonholes 50 and fastening one or more parts of the article of apparel as in a common shirt stud. With the flexible communicative wiring 22, snap fastener 24 and battery 36 shown through a cut-away, are housed in an internal pocket.

Figure 5:
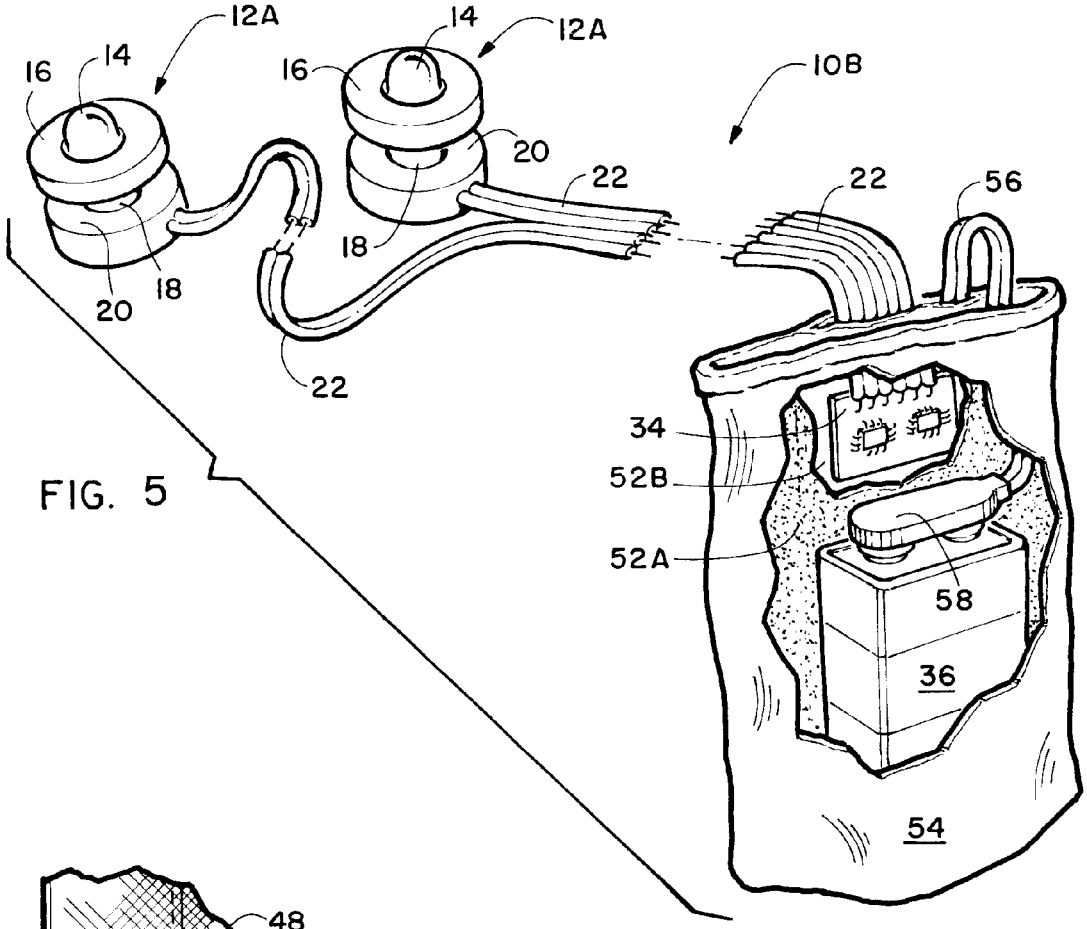
FIG. 5 depicts an alternate embodiment of the device showing two typical illumination buttons attached by the means of a flexible wiring harness, housed separately from the battery in a pocket of a soft flexible pouch housing the battery.

FIG. 5 depicts an alternate embodiment of the multipurpose illumination device 10B, with two illumination buttons 12A shown with conventional light emitting diodes 14. The battery 36 and circuit board 34 will be housed in separate pockets 52A and 52B of a soft flexible pouch 54. An additional connecting wire 56 will be required to translate between pocket 52A and 52B to connect a conventional battery snap fastener 58 and battery 36 to circuit board 34. This would allow that the battery 36 be easily changed without affecting the circuit board 34 housed in the sealed pocket 52B.

Figure 7:
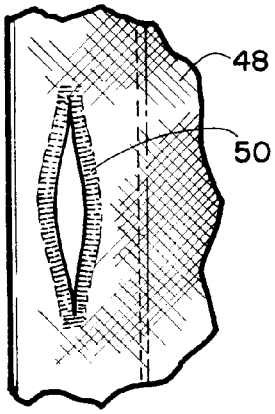
FIG. 7 depicts a common buttonhole in a fabric.
Figure 6:
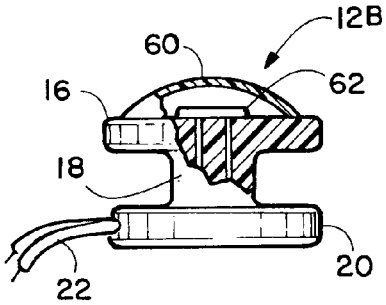
FIG. 6 depicts an alternate embodiment of the illumination buttons with a transparent dome cover and broken away to show a surface-mounted light emitting element.
Figure 8:
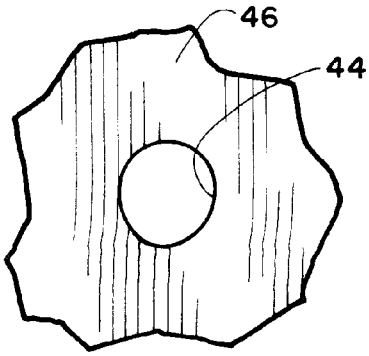
FIG. 8 depicts an orifice in a flexible material capable of inserting the illumination button.

An alternate embodiment of the illumination button 12B is illustrated in FIG. 6 with a similar top section 16, shank section 18 and bottom section 20 attached by communicative wiring 22. A transparent dome 60 may cover a surface-mounted light emitting diode or alternative lighting device 62. FIGS. 7 depicts a common buttonhole 50 in a dress shirt 48 or similar garment, and FIG. 8 depicts a punched orifice 44 through a flexible material, plastic, leather or any other like material 46.

The circuit board 34 housing the control circuit distributes power to the illumination buttons 12A and may be designed so that all the lights are lit or energized simultaneously and continuously, or individually and selectively. The brightness, duration, and timing of the illumination for each light, is determined by the control circuitry, such as a timing circuit. The resulting animation may be sequential, random, or designed to produce a particular pattern or multiple patterns. The control circuitry may be constructed by a variety of standard methods. These approaches may involve discrete analog parts and integrated circuits, or it may be preferable to use a microprocessor-based circuit.

The power source used for the apparatus may be, but is not limited to a nine volt battery 36 with the snap connectors being sufficiently small enough to be hidden inconspicuously inside a garment. Optional watertight enclosures and soft flexible pouches or a battery pack may be used for housing the circuitry and battery of this unique apparatus.

While the present invention has been described herein, with reference to particular embodiments thereof, a latitude of modifications, various changes and substitutions are intended in the forgoing disclosure, and it will be appreciated that in some instance some features of the invention will be employed without a corresponding use of other features without departing from the scope of the invention as set forth.

I claim:

1. A multi-purpose illuminating button comprising:

a first button-like member;

a second button-like member attached to said first member by a shank section;

a light emitting element mounted to said first member and having at least two electrode contacts for emitting light when a voltage potential is applied to said contacts; and wherein said shank section is a rigid tubular portion having a substantially small diameter relative to said first and second members.

2. An illumination apparatus adaptable for use on an article of wearing apparel, comprising:

a self contained housing for removably fastening one or more parts of the article of apparel;

an illuminating element encased in said housing for directing light away from the article of apparel;

a control circuit for selectively energizing said illuminating element; and a conductor for providing a conductive pathway between said illuminating element and said control circuit.

3. An illumination apparatus as recited in claim 2, wherein the shape of said housing resembles a shirt button stud.

4. An illuminating apparatus as recited in claim 2, wherein said housing is formed of molded plastic.

5. An illuminating apparatus as recited in claim 2, wherein at least a portion of said conductor is encased in said housing.

6. An illuminating apparatus as recited in claim 2, wherein said housing encases said illuminating element such that the magnifying end of said illuminating element protrudes beyond said housing.

7. An illumination apparatus as recited in claim 2, wherein said housing comprises:

a first button-like member;

a second button-like member;

a shank section connecting said first member to said second member.

8. An illuminating apparatus as recited in claim 2, wherein said illuminating element is a light emitting diode.

9. An illuminating button, comprising:

a self contained housing approximately sized to be removably fastened to an article through one of: (1) an orifice, (2) buttonhole, and (3) loose fabric weave; and a light emitting element mounted in said housing and having at least two electrode contacts for emitting light when a voltage potential is applied to said contacts.

10. An illuminating button as recited in claim 9 wherein said housing resembles a common button stud.

11. An illuminating button as recited in claim 9, wherein said article is an article of apparel.

* * * * *